US005205986A

United States Patent [19]

Noordegraaf et al.

[11] Patent Number: 5,205,986

[45] Date of Patent: * Apr. 27, 1993

[54] ALUMINIUM-STRONTIUM MASTER ALLOY AND PROCESS OF MAKING THE ALLOY

[75] Inventors: Jan Noordegraaf, TE Delfzijl; Piet Krahmer; Martin Donnelly, both of AT Arnhem, all of Netherlands

[73] Assignee: Shell Research Limited, United Kingdom

[ * ] Notice: The portion of the term of this patent subsequent to Sep. 3, 2008 has been disclaimed.

[21] Appl. No.: 592,476

[22] Filed: Oct. 5, 1990

[30] Foreign Application Priority Data

Oct. 5, 1989 [GB] United Kingdom ..... 8922487

[51] Int. Cl.[5] ..... C22C 1/03; B22F 9/08

[52] U.S. Cl. ..... 420/528; 75/338; 75/339; 75/352; 148/437; 420/549; 420/552; 420/590

[58] Field of Search ..... 420/528, 552, 590, 549; 148/437; 75/338, 339, 352

[56] References Cited

U.S. PATENT DOCUMENTS 4,576,791 3/1986 Thistlethwaite ..... 420/552
5,045,110 9/1991 Vader et al. ..... 75/338

OTHER PUBLICATIONS

"Spray Deposition of Metal Powers", *Metals Handbook* (9th Ed.), vol. 7 (Powder Metallurgy), pp. 530–532.

*Primary Examiner*—Richard O. Dean
*Assistant Examiner*—Robert R. Koehler

[57] ABSTRACT

A process is described for the preparation of an aluminum-strontium master alloy suitable for use as structure refiner during the solidification of molten aluminum-silicon alloys, comprising atomizing a stream of molten alloy containing aluminum and 5 to 35% by weight of strontium and collecting atomized particles as solid material on a collecting surface.

19 Claims, No Drawings

ALUMINIUM-STRONTIUM MASTER ALLOY AND PROCESS OF MAKING THE ALLOY

The invention relates to a process for the preparation of aluminium-strontium master alloys, to master alloys thus obtained and to the use of these master alloys as structure refiner during the solidification of molten aluminium-silicon alloys.

Aluminium-silicon alloys are widely used for the production of cast products as aircraft parts, internal combustion engine parts as pistons and valve sleeves, etc. To obtain cast products of a suitable (high) quality it is essential to add a structure refiner to the molten alloy to induce the formation of relatively small silicon crystals during the solidification. The thus obtained cast products show increased mechanical properties as ductility, strength, etc. when compared with the case that a structure refiner is not used.

In this specification the term structure refiner is used for a compound or composition which, after addition and mixing and/or dissolution in a molten metal or alloy, either as such or as a newly formed compound, induces during solidification the formation of smaller crystals than would have been the case when the structure refiner would not have been used.

Heretofore, sodium has been used as a structure refiner for the aforesaid aluminium-silicon alloys, especially for eutectic or hypo-eutectic aluminium-silicon alloys, i.e. alloys containing up to about 12% by weight of silicium. More recently strontium has been used instead of sodium because it gives a better structure refining effect than sodium, together with a more economical (limited burnoff loss compared with sodium) and less dangerous process.

During the solidification of hypo-eutectic aluminium-silicon alloys first primary aluminium crystals are formed until the eutectic composition is obtained, whereafter simultaneously aluminium crystals together with silicon crystals are formed. The silicon crystals show an acicular form and are fairly large when no structure refiner is used. When a structure refiner is used these silicon crystals are relatively small and show a fibrous character, resulting in the above described improved properties.

It is presumed that upon dissolving an aluminium-strontium master alloy small particles of aluminium-strontium intermetallics ($Al_4Sr$) are liberated which at their turn dissolve and thus provide strontium in solution, whereafter the strontium during the solidification increases the number of silicon crystals substantially, resulting in a large number of small crystals instead of a small number of large crystals.

Strontium may be added to the aluminium-silicon melt as a pure metal or as a master alloy. As the addition of metallic strontium is quite troublesome, the strontium is predominantly added in the form of master alloys. In this respect reference is made to U S. Pat. No. 4,009,026, describing a strontium-silicon-aluminium master alloy, and U.S. Pat. No. 3,567,429, describing a strontium-silicon master alloy. The processes for the preparation of the master alloys described in the above mentioned patents, however, are quite laborious and expensive. Further, the thus obtained master alloys have contact times of between five and thirty minutes before the refining effect is fully obtained. These alloys have a microstructure in which especially the $AlSr_4$ particles are coarse. This results in the long contact times and is furthermore detrimental to the ductility of the product. Attempts have therefore been made to prepare quick dissolving aluminium-strontium master alloys to allow in-line (addition in the launder) feeding and which have sufficient ductility to enable coiling and decoiling.

The dissolution velocity of conventionally cast aluminium- strontium master alloys, however, is low, especially when the amount of strontium in the alloy is more than 5% by weight. Furthermore, these alloys are usually very brittle, which makes it impossible to use conventional coil feeders. See for instance U.S. Pat. No. 4,576,791. Especially the low dissolving velocity is a clear disadvantage as the master alloys are preferably added just immediately before casting in view of the high oxidation velocity of strontium. This holds especially in the case of launder feeders.

It has now been found that very suitable aluminium-strontium master alloys containing a relatively large amount of strontium may be obtained by atomisation of molten alloy and collecting atomised particles on a collecting surface. The master alloys thus obtained, either as such or after working, e.g. grinding, rolling and/or extrusion, dissolve very rapidly in liquid aluminium and alloys, are substantially homogeneous, i.e. do not contain coarse $Al_4Sr$ particles, and are very suitable for use as effective structure refiners of eutectic and hypo-eutectic aluminium-silicon alloys. Due to their high ductility (elongation >5-10%) in-line feeding using conventional coil feeders is possible.

The present invention therefore relates to a process for the preparation of an aluminium-strontium master alloy suitable for use as structure refiner during the solidification of molten aluminium-silicon alloys, comprising atomising a molten alloy containing aluminium and 5 to 35% by weight of strontium and collecting atomised particles as a solid mass on a collecting surface.

The master alloys obtained by the above described process are very efficient structure refiners for aluminium-silicon alloys, especially eutectic and hypo-eutectic alloys. The amount of strontium taken up in the casting alloy is extremely high, and is usually between 95 and 100%. Under normal circumstances there is no gas pick up during the addition, while also dross formation is very small or even absent. The master alloys are effective for low as well as high cooling rates in the aluminium-silicon alloys in which they should be active. The dissolution velocity is high (usually less than one minute). The temperature loss is relatively low when compared with conventionally cast aluminium-strontium master alloys which contain less strontium. As the alloy obtained is very ductile, the alloy may be produced in the form of wire or coils, thus making it possible to feed the alloy using conventional coil feeders.

The amount of strontium is preferably between 7.5 and 25% by weight, more preferably between 10 and 20% by weight. The amount of aluminium in the master alloy will usually be between 65-95% by weight, preferably between 70 and 90%, preferably at least 75%. Minor amounts of one or more other elements may be present in the master alloy, for instance iron and silicon. Also trace amounts of the usual impurities may be present. All percentages by weight in this specification are calculated on the total weight of the master alloy.

In a preferred embodiment the master alloy also contains titanium and/or boron as these elements show a very good structure refining effect on aluminium crystals, thus resulting in aluminium-silicon casting alloys having further improved properties. The amount of titanium is suitably between 0.5 and 5% by weight, the amount of boron is suitably between 0.02 and 2% by weight. Preferably the amount of titanium is between 1 and 3% by weight and the amount of boron between 0.05 and 1% by weight.

The atomisation/collection process to be used in the present invention is known in the literature as melt spray deposition. More specific melt-spray deposition processes are the so-called Osprey process and the centrifugal spray deposition process. In this respect reference is made to the Metals Handbook, 9th edition, Volume 7, Powder Metallurgy, pages 530 to 532 and the references cited therein. In both processes a molten stream of metal or alloy is atomised, and the spray of metal droplets thus obtained is directed to a target where the metal or alloy is collected before full solidification has occurred, whereafter full solidification occurs.

A very suitable atomisation process which can be used in the process of the present invention is gas atomisation. This is the so called Osprey process. A stream of liquid alloy passes a nozzle where it is atomised into small droplets which droplets are cooled and partly solidified during their following flight until they reach the target plate. A suitable atomisation gas is an inert gas. Nitrogen and argon may be used, especially nitrogen. A typical metal flow rate varies between 1 and 100 kg/min, especially between 2 and 40 kg/min, more especially between 3 and 10 kg/min. A typical gas flow rate varies between 1 and 200 kg/min, especially between 10 and 50 kg/min, more especially between 3 and 20 kg/min. The gas pressure is suitably chosen between 100 and 5000 kPa. The temperature of the molten alloy is suitably chosen from the melting point of the alloy to a temperature 25° to 250 ° C. above the melting point, especially 50° to 150° C.

The solid mass obtained in the process of the present invention may be used for structure refining purposes as such, or, preferably, may be transformed by working into more suitable forms, for instance by extrusion into wire or rod or by rolling into rods, strips or sheets. Other methods for transforming the mass into more suitable forms are e.g. grinding or milling, followed by consolidation, e.g. extrusion, cold or hot pressing and sintering. Net shaped articles may be produced, but usually billets, rod, strip, wire and tubing products are produced. Preferably the spray-deposited material is deformed to make rod or wire, preferably by rolling or extrusion.

The amount of master alloy to be added to the cast alloy is usually chosen in such a way that the desired degree of structure refining is obtained. The actual amount may be determined in each case by the make up of the particular aluminium-silicon alloy to be treated, the cooling rate and the degree of structure refinement desired. Generally the master alloy is added to the molten aluminium-silicon alloy in an amount which introduces at least 0.002% (w/w) strontium in the alloy, and preferably between 0.01 and 0.10% (w/w), more preferably between 0.015 and 0.05% (w/w).

The use of the before mentioned master alloys is especially suitable in the case of eutectic and hypoeutectic aluminium- silicon alloys. The amount of silicon in such alloys varies between 3 and 12% (w/w), especially between 6 and 11% (w/w). Further, some minor amounts of other elements may be present in the alloy, for instance iron (up to 3%), copper (up to 6%), manganese (up to 1%), magnesium (up to 2%), nickel (up to 3%), chromium (up to 1%), zinc (up to 3%) and tin (up to 1%). Also trace amounts of the usual impurities may be present.

The invention further relates to the master alloys which are obtained by the above described processes and to the use of these master alloys in the structure refining during the solidification of aluminium-silicon cast alloys. The invention also relates to a process for the structure refining during the solidification of aluminium-silicon alloys, especially eutectic and hypoeutectic aluminium-silicon alloys, and to aluminium-silicon alloys thus prepared, as well as to products made from these alloys.

EXAMPLES

Example 1

A molten aluminium alloy containing 30% strontium was heated by induction to 950° C. and poured through a 4.5 mm diameter nozzle. It was atomised by nitrogen gas at a pressure of 9 bar and the spray was deposited on a rotating disc to form a solid cylinder of aluminium-strontium alloy having a diameter of 150 mm.

Example 2

A molten aluminium alloy containing 10% strontium was heated by induction to 950° C. and poured through a 4.5 mm diameter nozzle. It was atomised by nitrogen gas at a pressure of 4.8 bar and the spray was deposited on a rotating disc to form a solid cylinder of aluminium-strontium alloy having a diameter of 160 mm.

Example 3

A molten aluminium alloy containing 10% strontium was heated by induction to 780° C. and poured through a 4.5 mm diameter nozzle. It was atomised by nitrogen gas at a pressure of 8.5 bar and the spray was deposited on a rotating disc to form a solid cylinder of aluminium-strontium alloy having a diameter of 150 mm.

Example 4

A molten aluminium alloy containing 15% strontium was heated by induction to 780° C. and poured through a 4.5 mm diameter nozzle. It was atomised by nitrogen gas at a pressure of 8.5 bar and the spray was deposited on a rotating disc to form a solid cylinder of aluminium-strontium alloy having a diameter of 150 mm.

Example 5

Extrusion billets were machined from the cylinders spray-deposited in Examples 1, 3 and 4, and these were extruded to rods of 6 mm diameter. The rods were ductile and could be easily bent to form a coil of the material. The rods thus produced were used for structure refining of an aluminium-7% silicon-0.4% magnesium alloy. The amount of strontium added was 0.03% by weight of the ultimate alloy. The cooling rate of the cast alloy was 8° C./s. Upon microscopical inspection of treated and untreated casted alloys it appeared that a clear structure refining had taken place.

Example 6

An extrusion billet was machined from the cylinder spray-deposited in Example 2, and this was extruded to rod of 10 mm diameter. The rod was ductile and could be easily bent to form a coil of the material. Pieces of this rod were used to modify the structure of an aluminium-7% silicon alloy. They were added to the molten alloy at a temperature of 700° C. The amount of strontium added to the alloy was 0.016% by weight of the ultimate alloy. Samples were taken from the molten alloy before the addition and after time intervals of one, eight, and fifteen minutes following the addition of the aluminium-strontium extruded rod, and the samples were poured into graphite crucibles and allowed to cool at about 1 K/s. The sample taken before addition had a structure containing relatively large angular silicon crystals in the aluminium matrix. Good modification of the structure to give finer, more rounded silicon crystals was obtained in all three samples taken after the addition, that after eight minutes being slightly better than the other two.

The dissolution rate of the Al-10Sr alloy in the above indicated experiment is less than one minute, which is clearly faster (at least two times) than the same amount of a conventional cast and rolled Al-3.5% Sr rod (resulting in a considerable smaller amount of strontium in the ultimate alloy). The dissolution time of an aluminium-5% strontium ingot is even considerably longer than the conventional cast and rolled Al-3.5% Sr rod.

What is claimed is:

1. In a process for the preparation of an aluminum-strontium master alloy suitable for use as a structure refiner during the solidification of molten aluminum-silicon alloys, comprising forming a molten alloy containing aluminum and 5–35% by weight of strontium, the improvement comprising atomizing a stream of said molten alloy and collecting atomized particles of said molten alloy as a solid mass on a collecting surface.

2. Process according to claim 1 in which the aluminum-strontium alloy contains 7.5–25% by weight of strontium.

3. Process according to claim 1 in which the aluminum-strontium alloy contains 65–95% by weight of aluminum.

4. Process according to claim 1, wherein the aluminium-strontium master alloy contains in addition to aluminium and strontium 05.–5% by weight of titanium and/or 0.02–2% by weight of boron.

5. Process according to claim 4, wherein the aluminium-strontium master alloy contains in addition to aluminium and strontium 1–3% by weight of titanium and/or 0.05–1% by weight of boron.

6. Process according to 1, wherein the atomisation process is a gas atomisation process.

7. Process according to claim 6, wherein the atomising gas is nitrogen.

8. Process according to claim 6, wherein the atomising gas is argon.

9. Process according to claim 1, wherein the metal flow rate of said atomized steam is between 2 and 40 kg/min.

10. Process according to claim 1, wherein the atomization occurs at a gas flow rate between 10 and 50 kg/min.

11. Process according to claim 1, wherein the temperature of the molten alloy is 50° to 150° C. above the melting point.

12. Process according to claim 1, wherein the spray-deposited metal is deformed to make rod or wire.

13. Process according to claim 12, in which the deformation process is rolling.

14. Process according to claim 12, in which the deformation process is extrusion.

15. Aluminium-strontium master alloy whenever prepared according to claim 1.

16. Process according to claim 1 in which the aluminum-strontium alloy contains 10–20% by weight of strontium.

17. Process according to claim 1 in which the aluminum-strontium alloy contains at least 75% by weight of aluminum.

18. Process according to claim 9, wherein the metal flow rate is between 3 and 10 kg/min.

19. Process according to claim 10, wherein the gas flow rate is between 3 and 20 kg/min.

* * * * *